US010280598B2

(12) United States Patent
Tzeng

(10) Patent No.: US 10,280,598 B2
(45) Date of Patent: May 7, 2019

(54) FAUCET ASSEMBLY

(71) Applicant: DAHATA INC., Jiangmen, Guangdong (CN)

(72) Inventor: Jeffery Tzeng, Guangdong (CN)

(73) Assignee: DAHATA INC., Jiangmen (CN)

( * ) Notice: Subject to any disclaimer, the term of this patent is extended or adjusted under 35 U.S.C. 154(b) by 152 days.

(21) Appl. No.: 15/155,109

(22) Filed: May 16, 2016

(65) Prior Publication Data

US 2017/0328040 A1 Nov. 16, 2017

(51) Int. Cl.
*F16K 43/00* (2006.01)
*E03C 1/04* (2006.01)

(52) U.S. Cl.
CPC ..... *E03C 1/04* (2013.01); *E03C 2001/0418* (2013.01)

(58) Field of Classification Search
CPC ..... E03C 1/04; E03C 1/023; F16K 11/0445; Y10T 137/87249
USPC ..... 137/315.13, 597, 603
See application file for complete search history.

(56) References Cited

U.S. PATENT DOCUMENTS

RE21,925 E * 10/1941 Smith ..... F16K 11/044 137/597
4,243,063 A * 1/1981 Parkison ..... F16K 11/0746 137/100
4,854,499 A * 8/1989 Neuman ..... E03C 1/04 137/624.2
6,321,777 B1 * 11/2001 Wu ..... F16K 27/045 137/315.12
6,363,961 B1 * 4/2002 Wang ..... E03C 1/04 137/119.05
6,446,655 B1 * 9/2002 Chang ..... G05D 23/1353 137/100
6,453,943 B1 * 9/2002 Chang ..... E03C 1/023 137/597
6,973,937 B1 * 12/2005 Yang ..... E03C 1/023 137/119.05
7,819,134 B2 * 10/2010 Izzy ..... E03C 1/021 137/606
2006/0207664 A1 * 9/2006 Yang ..... E03C 1/023 137/597
2012/0180887 A1 * 7/2012 Yan ..... F16K 11/0743 137/597

* cited by examiner

*Primary Examiner* — Reinaldo Sanchez-Medina

(57) ABSTRACT

A faucet assembly includes a faucet body defining a hot water inlet, a cold water inlet and at least one water outlet; a valve cartridge detachably received in the faucet body, the valve cartridge defines a mixing chamber and the hot water from the hot water inlet and the cold water from the cold water inlet is mixed in the mixing chamber and flows out via the water outlet; and a valve plate detachably assembled to the faucet body. The faucet body is provided with a hot water pipe connecting the hot water inlet and the mixing chamber. The hot water pipe is formed with a hot water stop valve assembly detachably assembled thereto. The faucet body is provided with a cold water pipe connecting the cold water inlet and the mixing chamber. The cold water pipe is formed with a cold water stop valve assembly detachably assembled thereto.

9 Claims, 13 Drawing Sheets

FAUCET ASSEMBLY

FIELD OF THE INVENTION

The present invention generally relates to faucet assemblies and, more particularly, to a faucet assembly which can readily realize exchange of hot water and cold water.

BACKGROUND OF THE INVENTION

It is well known in the art that a conventional wall thermostatic faucet generally includes a stop valve. When a hot water pipe and a cold water pipe are installed reversely by mistake, the pipes need to be converted or replaced by another wall thermostatic faucet capable of realizing exchange of hot water and cold water, which will unavoidably leads to waste.

In order to overcome the foregoing shortcoming, generally a conversion sleeve is disposed at the thermostatic valve cartridge of the wall thermostatic faucet. However, the conversion sleeve will not only increase the size of the faucet body, but also lead to failure of sharing a common panel and handle and poor commonality.

In view of the foregoing, what is needed, therefore, is to provide a faucet assembly which can readily realize exchange of hot water and cold water.

SUMMARY OF THE INVENTION

One object of the present invention is to provide a faucet assembly which can readily realize exchange of hot water and cold water.

In accordance with one embodiment of the present invention, a faucet assembly includes:

a faucet body defining a hot water inlet, a cold water inlet and at least one water outlet;

a valve cartridge having sealing and temperature control function detachably received in the faucet body, the valve cartridge defines a mixing chamber and hot water from the hot water inlet and cold water from the cold water inlet are mixed in the mixing chamber and flow out via the at least one water outlet; and a valve plate detachably assembled to the faucet body;

wherein the faucet body is provided with a hot water pipe connecting the hot water inlet and the mixing chamber, the hot water pipe is formed with a hot water stop valve assembly detachably assembled thereto, and the faucet body is provided with a cold water pipe connecting the cold water inlet and the mixing chamber, the cold water pipe is formed with a cold water stop valve assembly detachably assembled thereto.

According to one aspect of the present invention, the hot water stop valve assembly comprises a hot water stop valve body, a stop valve pole and a one-way valve; the cold water stop valve assembly comprises a cold water stop valve body, a stop valve pole and a one-way valve.

According to one aspect of the present invention, the hot water stop valve body defines a hot water hole corresponding to the one-way valve, and the hot water flows into the hot water valve body from the hot water inlet flows into the mixing chamber via the hot water hole; the cold water stop valve body defines a cold water hole corresponding to the one-way valve, and the cold water flows into the cold water valve body from the cold water inlet flows into the mixing chamber via the cold water hole.

According to one aspect of the present invention, the hot water stop valve body comprises a first positioning step for positioning the one-way valve, and the cold water stop valve body defines a second positioning step for positioning the one-way valve.

According to one aspect of the present invention, a first filter is seated at the hot water hole connecting the hot water stop valve body and the mixing chamber, and a second filter is seated at the cold water hole connecting the cold water stop valve body and the mixing chamber.

According to one aspect of the present invention, a first sealing ring is seated between the hot water stop valve body and the faucet body, and a second sealing ring is seated between the cold water stop valve body and the faucet body.

According to one aspect of the present invention, a first sealing member disposed between the hot water stop valve body and the faucet body is seated between the hot water chamber and the cold water chamber, and a second sealing member disposed between the cold water stop valve body and the faucet body is seated between the cold water chamber and the cold water chamber.

According to one aspect of the present invention, the hot water stop valve body and the cold water stop valve body are obtained via forging.

According to one aspect of the present invention, the valve cartridge is an ordinary thermostatic valve, a thermostatic valve having pressure balance function, or a thermostatic valve having closing function.

According to one aspect of the present invention, the at least one water outlet of the faucet body is formed with a two water change valve spool or a three water change valve spool.

According to one aspect of the present invention, the faucet body is detachably formed with a digital temperature display.

According to one aspect of the present invention, the valve cartridge is formed with a thermostat plastic sleeve.

According to one aspect of the present invention, the faucet body is obtained via forging or precious casting of copper, tin bronze or stainless steel 304.

Compared with the prior art, the faucet assembly of the present invention has the following advantages.

Firstly, after the faucet assembly of the present invention is inserted in a wall, the exchange of hot water and cold water can be readily realized via disconnecting and exchanging the hot water stop valve assembly and the cold water stop valve assembly. There is no need to destroy the wall and replace the whole faucet assembly.

Secondly, if pressure balance is needed, the valve cartridge is changed after disassembling the faucet assembly. There is no need to destroy the wall and replace the whole faucet assembly.

Thirdly, via the arrangement of the hot water stop valve assembly at the hot water inlet and the cold water stop valve assembly at the cold water inlet, the faucet assembly of the present invention can provide different properties.

Other advantages and novel features will be drawn from the following detailed description of preferred embodiments with the attached drawings. The accompanying drawings, which are incorporated in and constitute a part of this specification, illustrate embodiments of the present invention and, together with a general description of the invention given above, and the detailed description of the embodiments given below, serve to explain the principles of the invention.

DETAILED DESCRIPTION OF THE INVENTION

Figure 1:
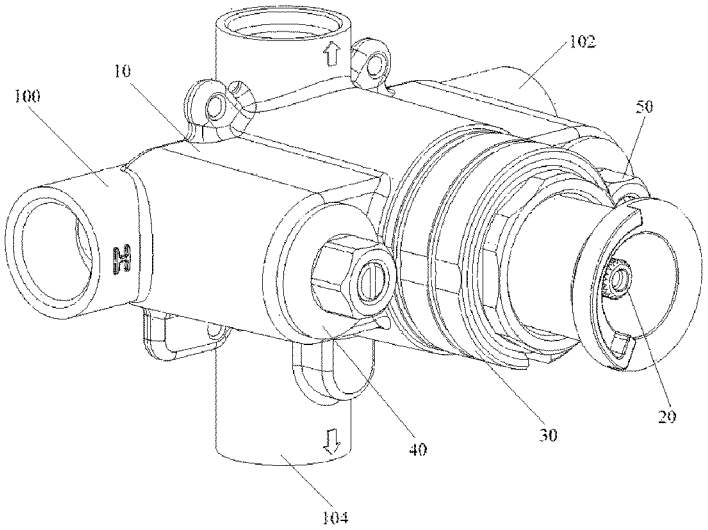
FIG. 1 depicts an exemplary assembled view of a faucet assembly according to a first embodiment of the present invention.

Example embodiments of the present invention will now be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like reference numerals refer to like elements throughout.

Referring to FIGS. 1 to 5, the faucet assembly according to a first embodiment of the present invention which can readily realize exchange of the hot water and the cold water includes a faucet body 10 defining a hot water inlet 100, a cold water inlet 102 and at least one water outlet 104; a valve cartridge 20 having sealing and temperature control function detachably received in the faucet body 10, the valve cartridge 20 defines a mixing chamber 200 and the hot water from the hot water inlet 100 and the cold water from the cold water inlet 102 are mixed in the mixing chamber 200 and flow out via the at least one water outlet 104; a valve plate 30 detachably assembled to the faucet body 10. The faucet body 10 is provided with a hot water pipe 120 for connecting the hot water inlet 100 and the mixing chamber 200. The hot water pipe is formed with a hot water stop valve assembly 40 detachably assembled thereto. The faucet body 10 is provided with a cold water pipe 140 for connecting the cold water inlet 102 and the mixing chamber 200 is formed with a cold water stop valve assembly 50 detachably assembled thereto.

Figure 2:
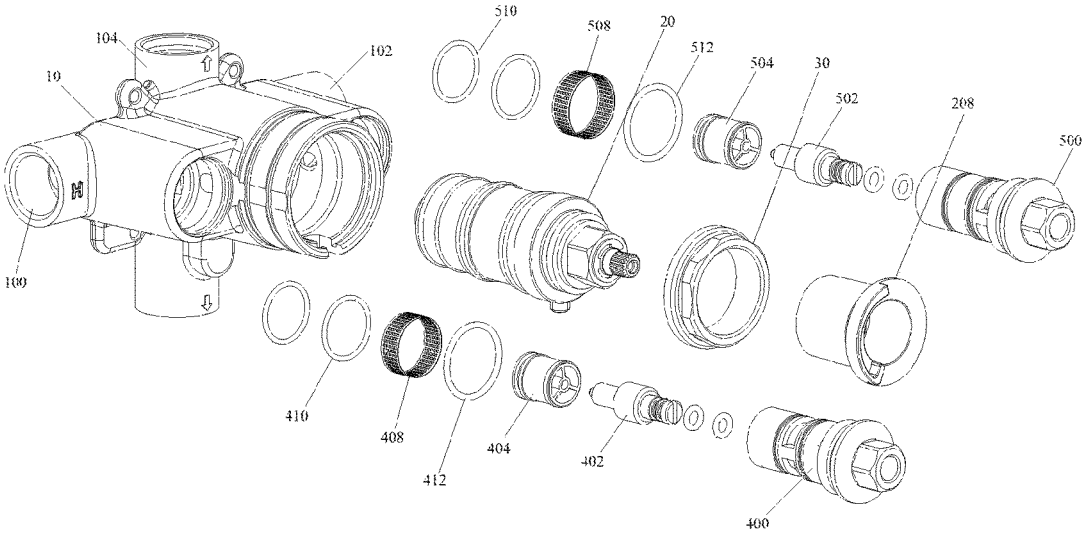
FIG. 2 depicts an exemplary perspective view of a faucet assembly according to the first embodiment of the present invention.
Figure 3:
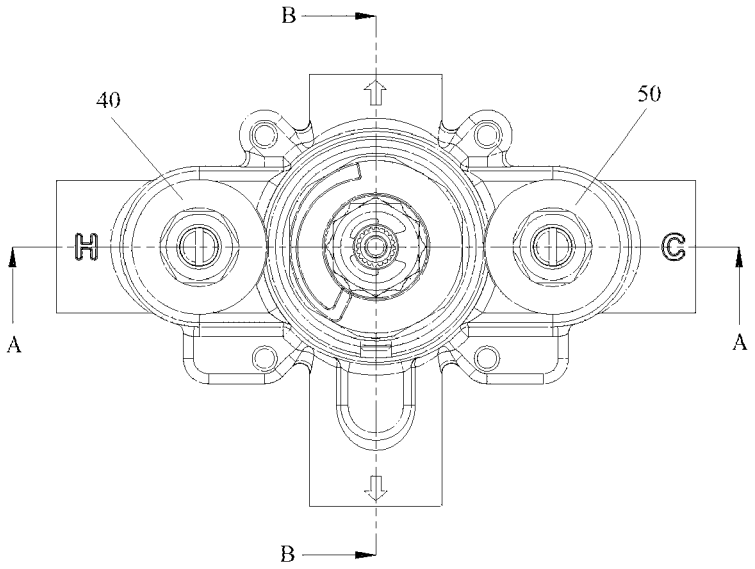
FIG. 3 depicts an exemplary front side view of the faucet assembly as shown in FIG. 1.
Figure 4:
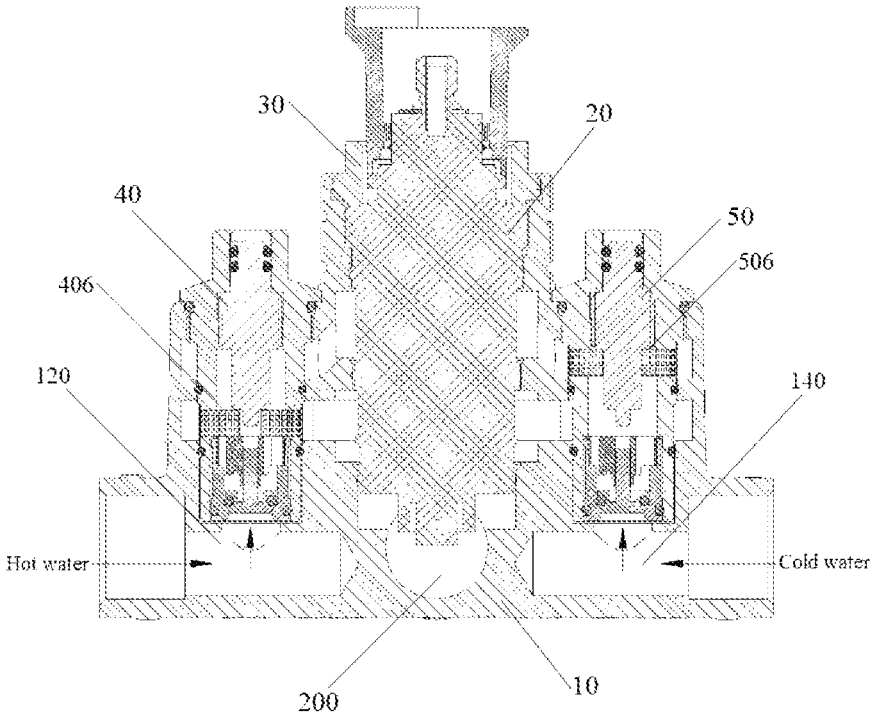
FIG. 4 depicts an exemplary cross-sectional view of the faucet assembly along a line A-A in FIG. 3, showing a flow direction of the water in the faucet assembly from a hot water inlet and a cold water inlet.
Figure 5:
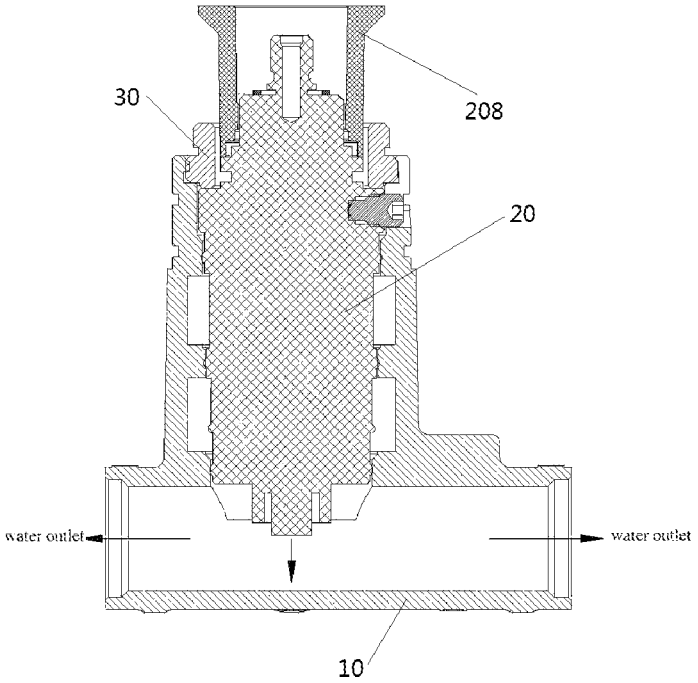
FIG. 5 depicts an exemplary cross-sectional view of the faucet assembly along a line B-B in FIG. 3, showing a flow direction of the water in the faucet assembly flowing out via a water outlet.
Figure 6:
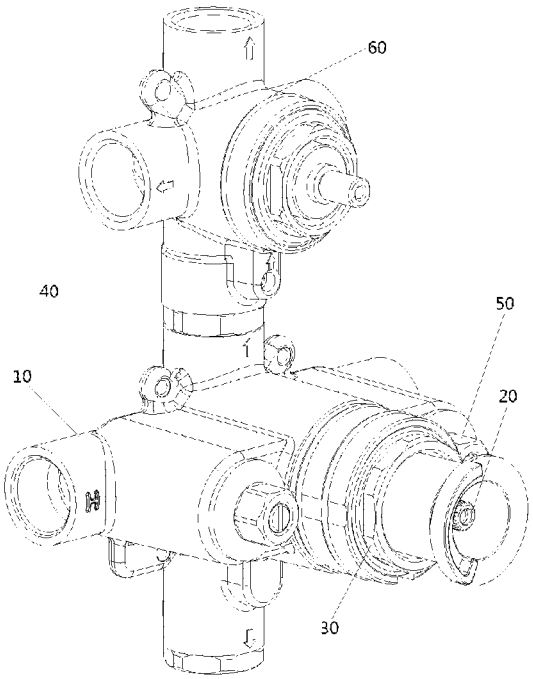
FIG. 6 depicts an exemplary assembled view of a faucet assembly according to a second embodiment of the present invention, wherein a water outlet is formed with a three water change valve spool.
Figure 7:
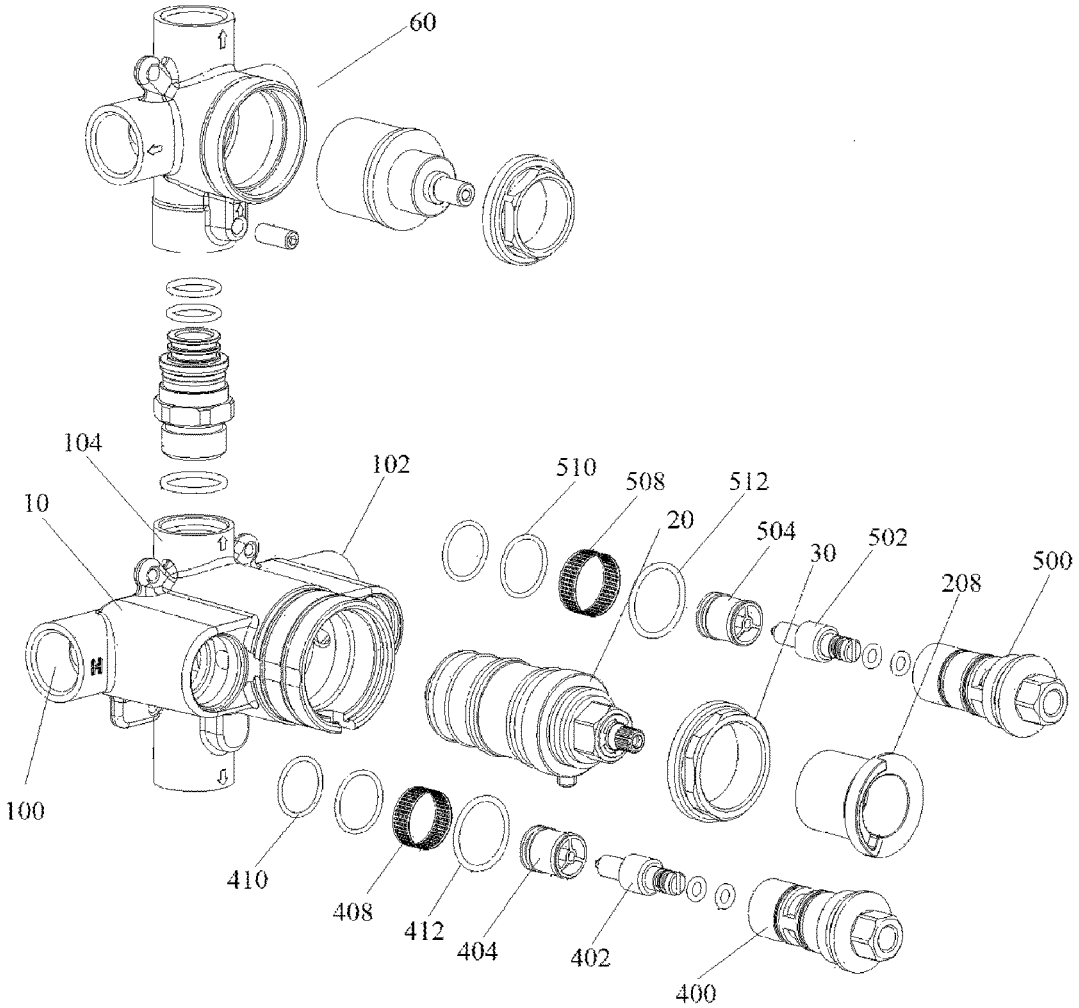
FIG. 7 depicts an exemplary perspective view of a faucet assembly according to the second embodiment of the present invention.
Figure 8:
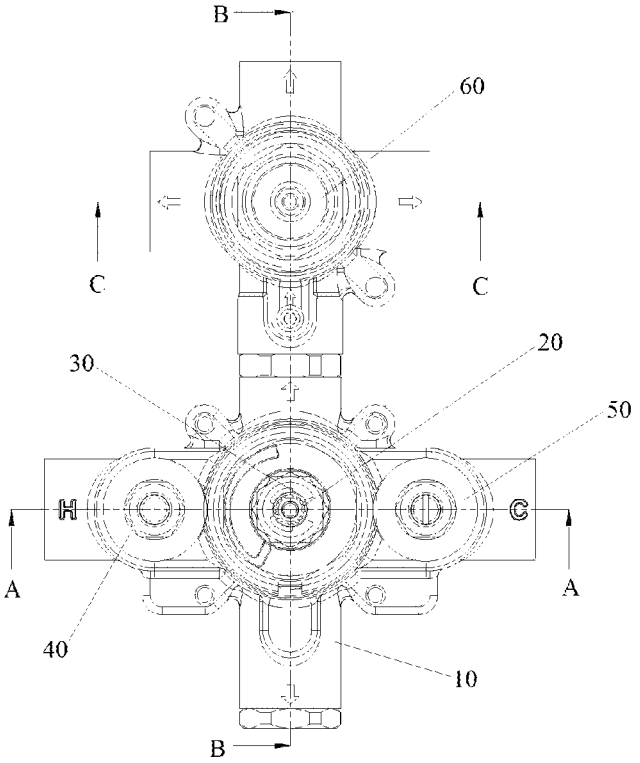
FIG. 8 depicts an exemplary front side view of the faucet assembly as shown in FIG. 6.
Figure 9:
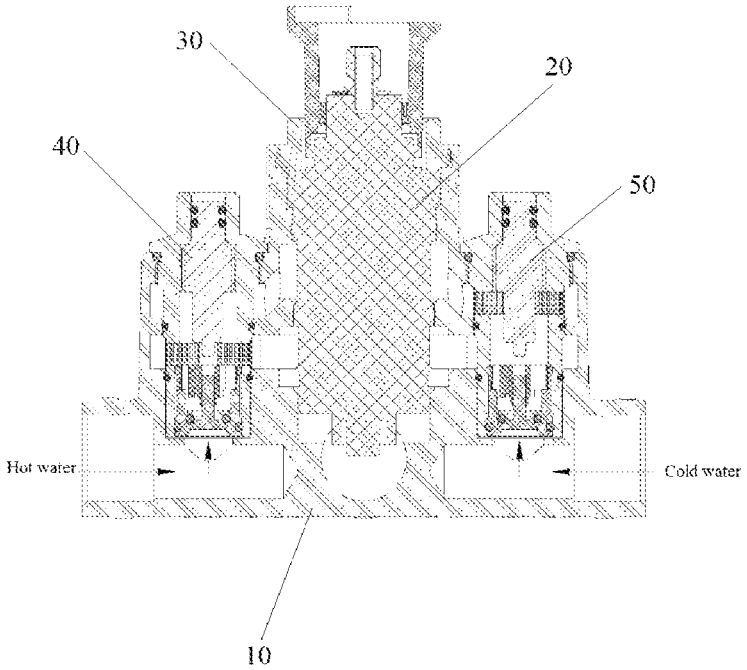
FIG. 9 depicts an exemplary cross-sectional view of the faucet assembly along a line A-A in FIG. 8, showing a flow direction of the water in the faucet assembly from a hot water inlet and a cold water inlet.
Figure 10A:
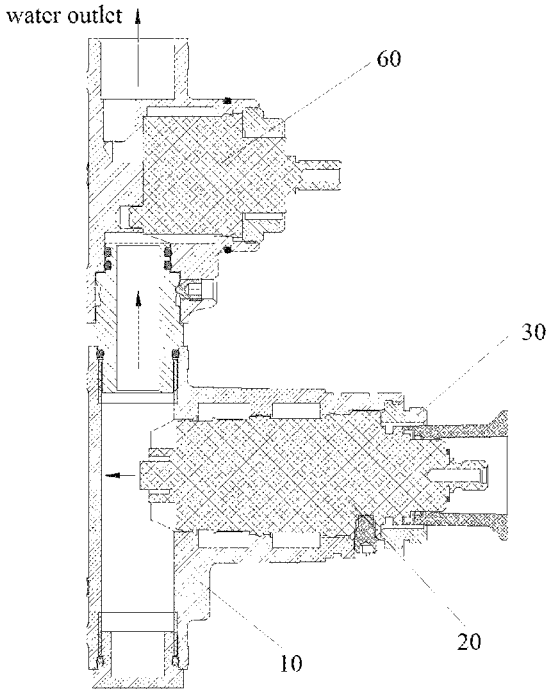
FIGS. 10A and 10B each depicts an exemplary cross-sectional view of the faucet assembly along a line B-B and a line C-C in FIG. 8, showing a flow direction of the water in the faucet assembly flowing out via a water outlet.
Figure 10B:
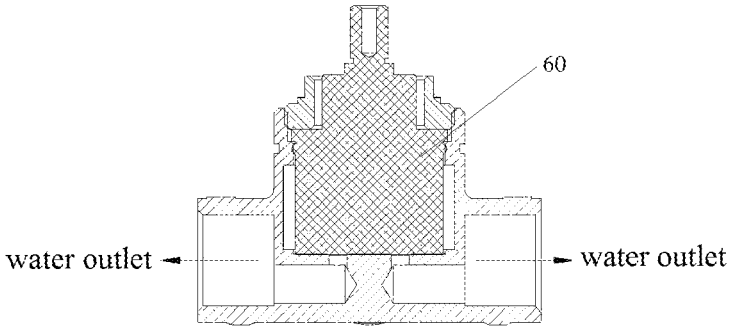
Figure 11:
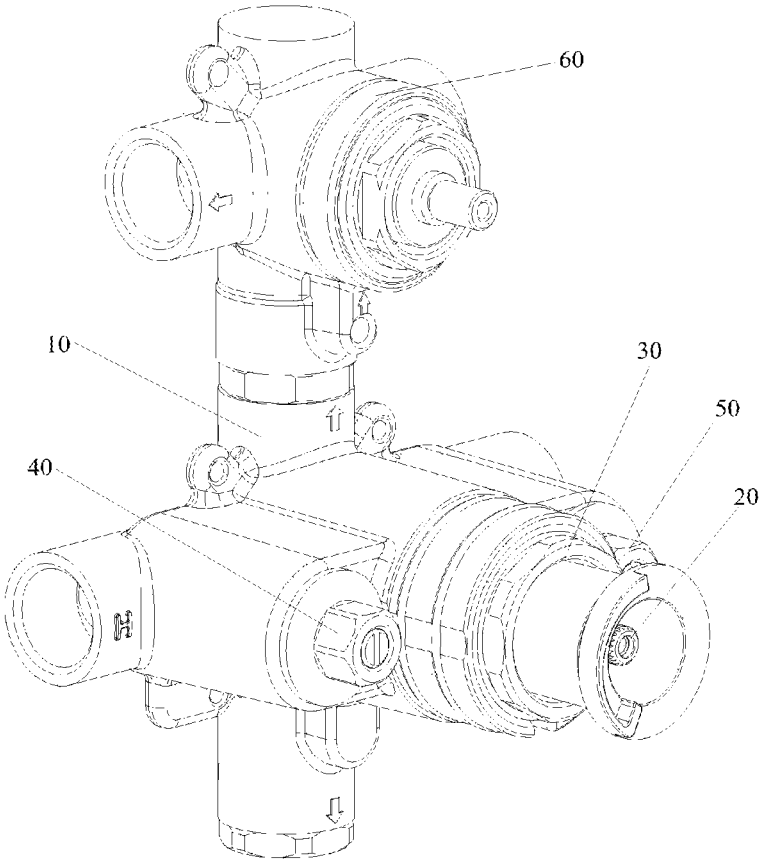
FIG. 11 depicts an exemplary assembled view of a faucet assembly according to a third embodiment of the present invention, wherein the outlet is formed with a two water change valve spool.
Figure 12:
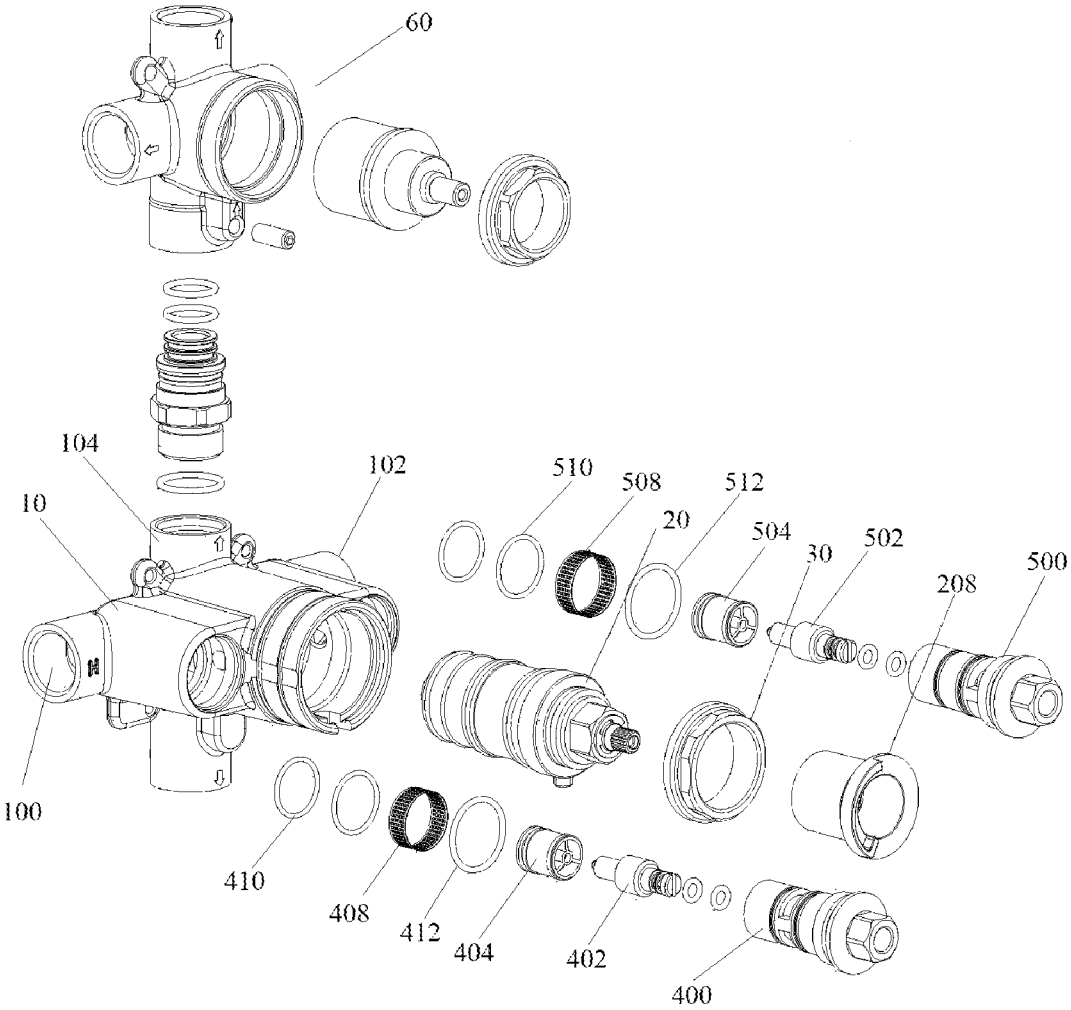
FIG. 12 depicts an exemplary perspective view of a faucet assembly according to the third embodiment of the present invention.
Figure 13:
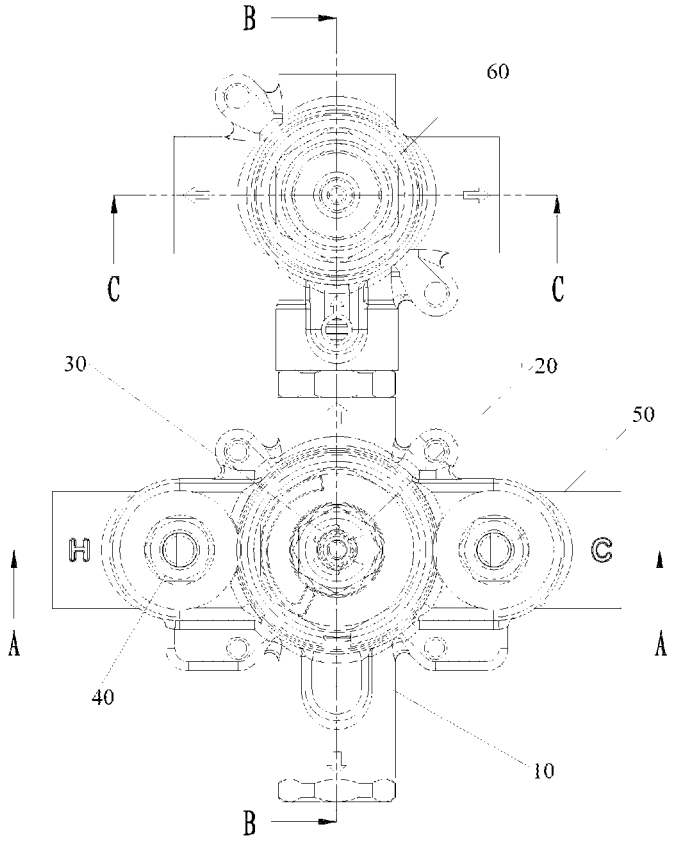
FIG. 13 depicts an exemplary front side view of the faucet assembly as shown in FIG. 11.
Figure 14:
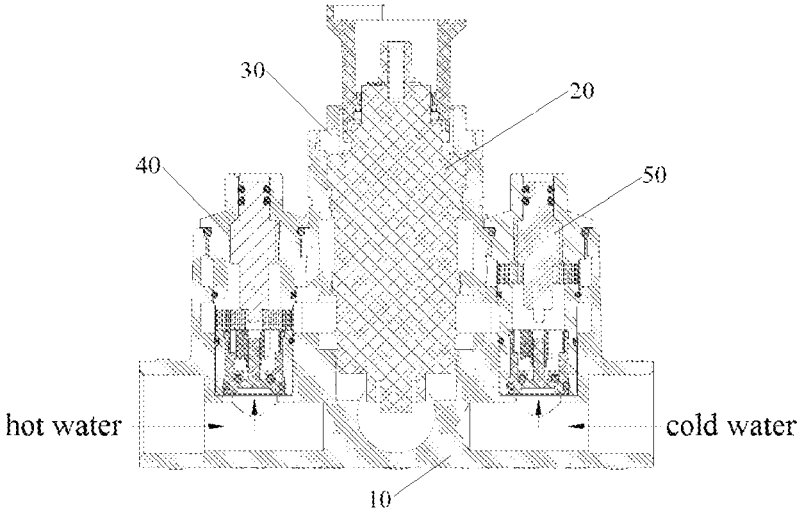
FIG. 14 depicts an exemplary cross-sectional view of the faucet assembly along a line A-A in FIG. 13, showing a flow direction of the water in the faucet assembly from a hot water inlet and a cold water inlet.
Figure 15A:
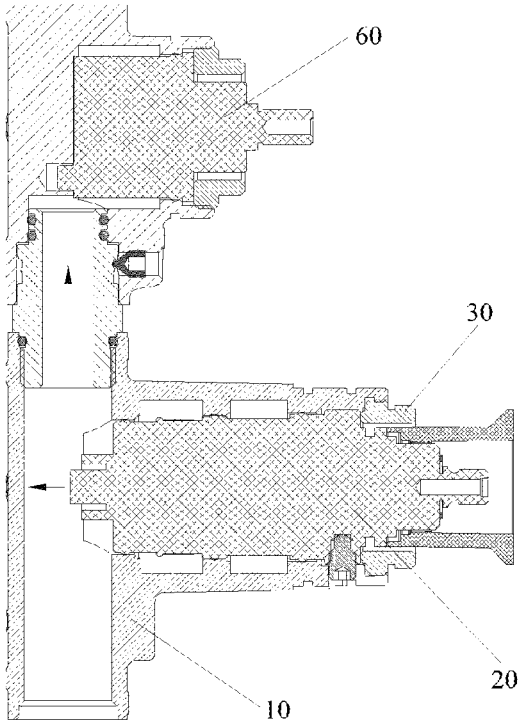
FIGS. 15A and 15B each depicts an exemplary cross-sectional view of the faucet assembly along a line B-B and a line C-C in FIG. 13, showing a flow direction of the water in the faucet assembly flowing out via a water outlet.
Figure 15B:
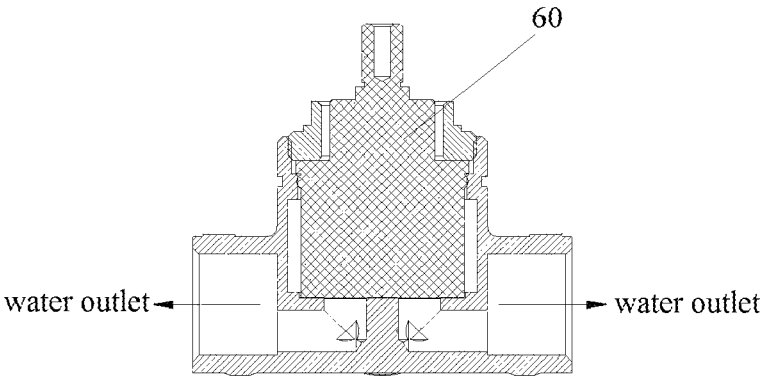
Figure 16A:
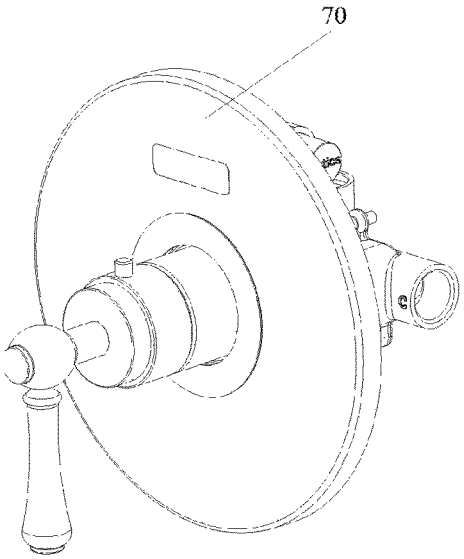
FIGS. 16A and 16B each depict an exemplary assembled view from different aspect of a faucet assembly according to a fourth embodiment of the present invention.
Figure 16B:
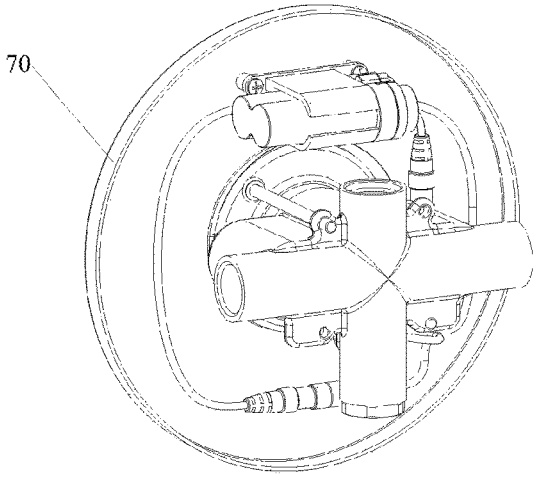
Figure 17:
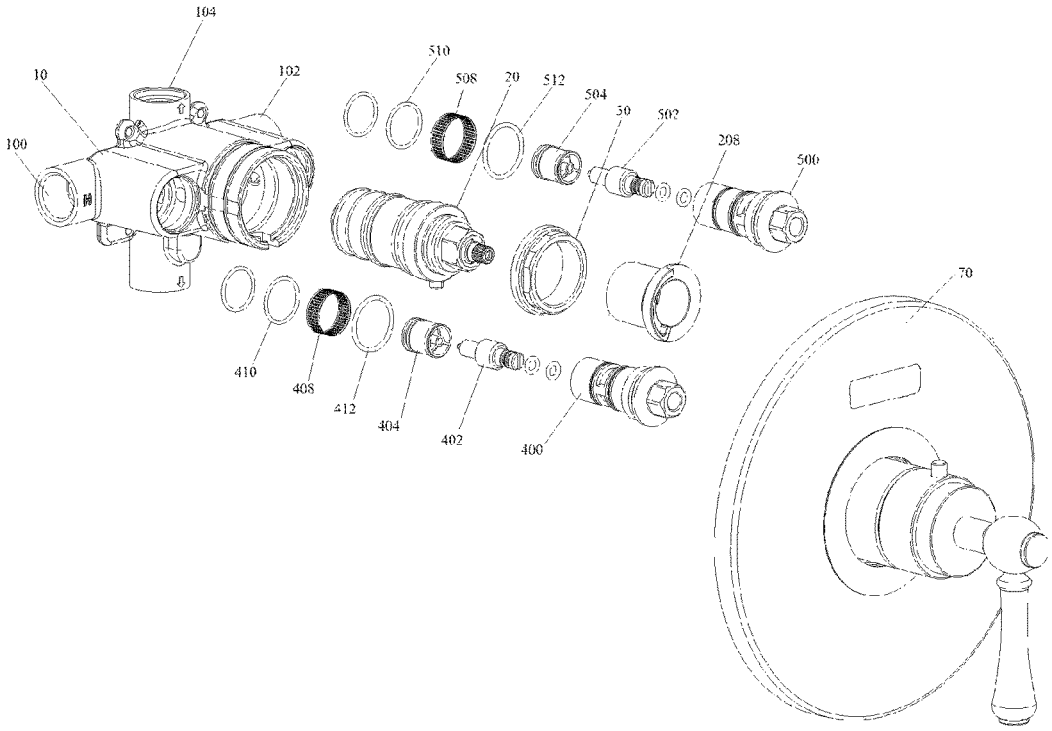
FIG. 17 depicts an exemplary perspective view of a faucet assembly according to the fourth embodiment of the present invention.
Figure 18:
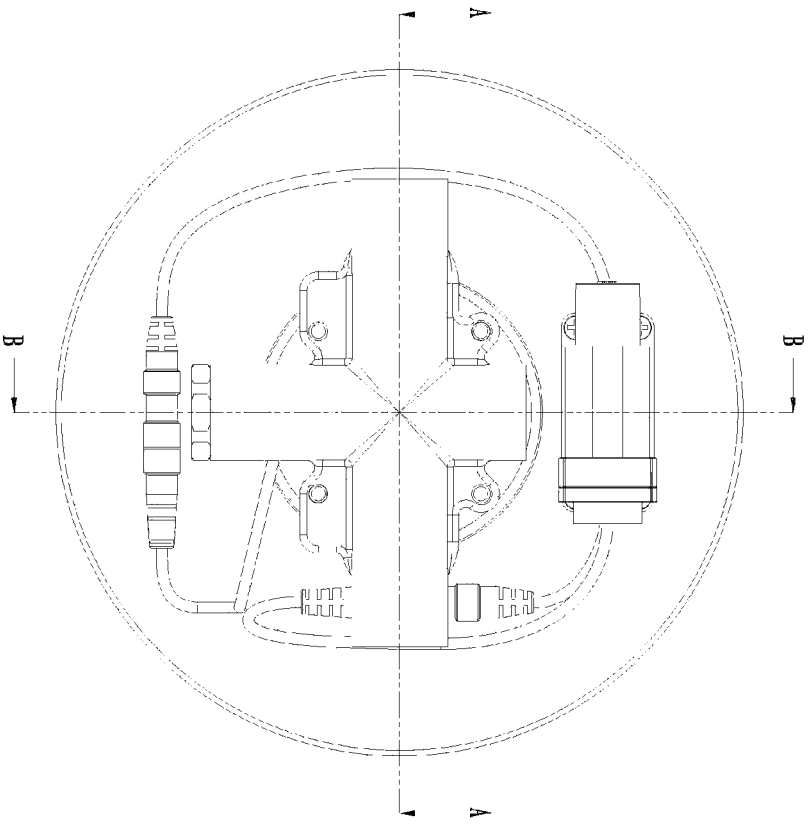
FIG. 18 depicts an exemplary front side view of the faucet assembly according to the fourth embodiment of the present invention.
Figure 19:
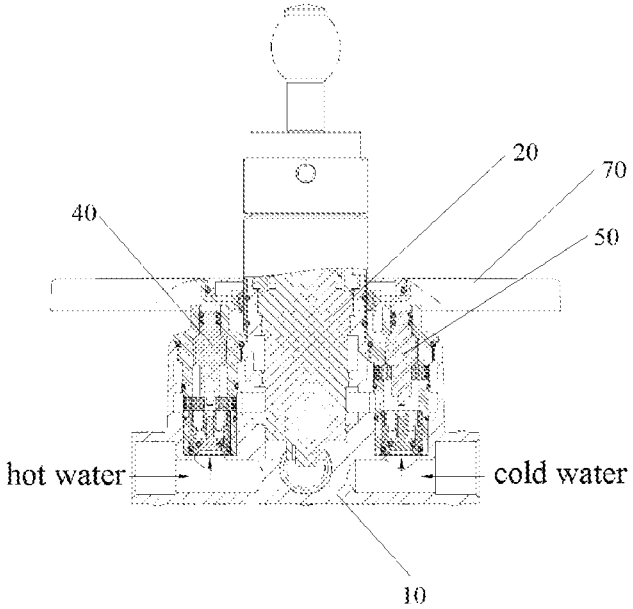
FIG. 19 depicts an exemplary cross-sectional view of the faucet assembly along a line A-A in FIG. 18, showing a flow direction of the water in the faucet assembly flowing out via a water outlet.
Figure 20:
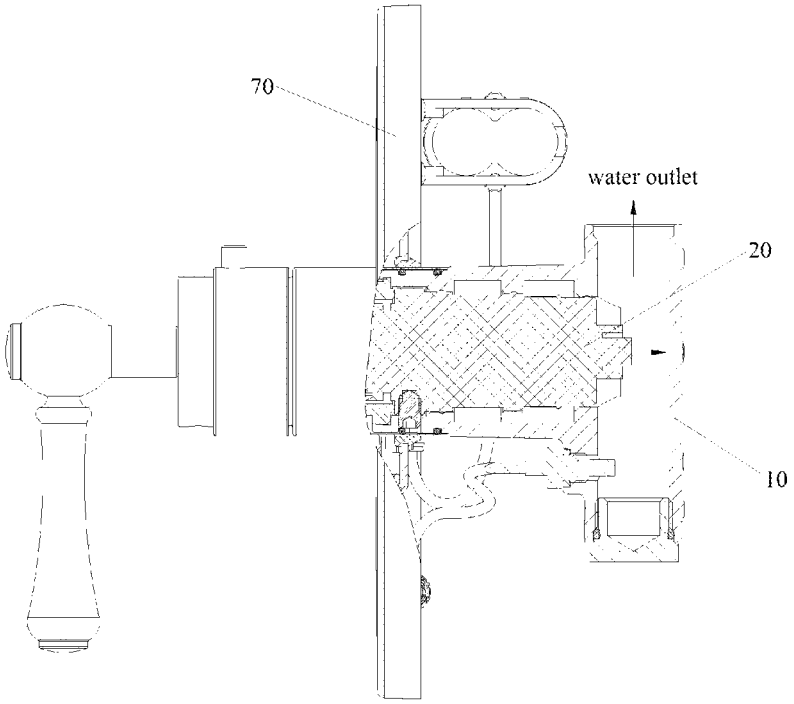
FIG. 20 depicts an exemplary cross-sectional view of the faucet assembly along a line B-B in FIG. 18, showing a flow direction of the water in the faucet assembly flowing out via a water outlet.

Referring to FIGS. 2 to 4, the hot water stop valve assembly 40 includes a hot water stop valve body 400, a stop valve pole 402 and a one-way valve 404. The hot water stop valve body 400 defines a hot water hole (not shown) for suitably receiving the one-way valve 404. The hot water flows into the hot water stop valve body 400 from the hot water inlet 100 flows into the mixing chamber 200 via the hot water hole. The hot water stop valve body 400 is provided with a first filter 408 at the hot water hole connecting the hot water stop valve body 400 and the mixing chamber 200, to prevent the debris from blocking the valve cartridge 20. In addition, the hot water stop valve body 400 is formed with a first positioning step 406 for positioning the one-way valve 404 as well as avoiding string of the hot water.

According to one embodiment of the present invention, the hot water stop valve body 400 is obtained via processing or forging. A first sealing ring 410 is seated between the water stop valve body 400 and the faucet body 10. A first sealing member 412 disposed between the hot water stop valve body 400 and the faucet body 10 is seated between the hot water chamber and the cold water chamber.

Referring to FIGS. 2 to 4, the cold water stop valve assembly 50 includes a cold water stop valve body 500, a stop valve pole 502 and a one-way valve 504. The cold water stop valve body 500 defines a cold water hole (not shown) for suitably receiving the one-way valve 504. The cold water flows into the cold water stop valve body 500 from the cold water inlet 102 flows into the mixing chamber 200 via the cold water hole. The cold water stop valve body 500 is provided with a second filter 508 at the cold water hole connecting the cold water stop valve body 500 and the mixing chamber 200, to prevent the debris from blocking the valve cartridge 20. In addition, the cold water stop valve body 500 is formed with a second positioning step 506 for positioning the one-way valve 504 as well as avoiding string of the cold water.

According to one embodiment of the present invention, the cold water stop valve body 500 is obtained via processing or forging. A second sealing ring 510 is disposed between the cold water stop valve body 500 and the faucet body 10. A second sealing member 512 disposed between the cold water stop valve body 500 and the faucet body 10 is seated between the hot water chamber and the cold water chamber.

It should be appreciated that there is no particular limitations to the valve cartridge 20. For instance, according to one embodiment of the present invention, the valve cartridge 20 can be an ordinary thermostatic valve, or a thermostatic valve having pressure balance function, or a thermostatic valve having closing function. In addition, in the illustrated embodiment, the valve cartridge 20 is formed with a thermostat plastic sleeve 208.

FIGS. 6 to 10 illustrate a faucet assembly according to a second embodiment of the present invention. The second embodiment of the present invention is almost the same as the first embodiment of the present invention, only differing from the first embodiment of the present invention in that the water outlet of the faucet body 10 is formed with a water change valve spool 60 (three water change valve spool), to readily realize exchange of different types of valve cartridges.

FIGS. 11 to 15 illustrate a faucet assembly according to a third embodiment of the present invention. The third embodiment of the present invention is almost the same as the first embodiment of the present invention, only differing from the first embodiment of the present invention in that the water outlet of the faucet body 10 is formed with a water change valve spool 60 (two water change valve spool), to readily realize exchange of different types of valve cartridges.

FIGS. 16 to 20 illustrate a faucet assembly according to a fourth embodiment of the present invention. The fourth embodiment of the present invention is almost the same as the first embodiment of the present invention, only differing from the first embodiment of the present invention in that the faucet body 10 is detachably coupled with a digital temperature display 70.

In view of the embodiments of the present invention, the faucet assembly of the present invention has the following advantages relative to the conventional faucet assemblies.

Firstly, after the faucet assembly of the present invention is inserted in a wall, exchange of the hot water and the cold water can be readily realized via disconnecting and exchanging the hot water stop valve assembly 40 and the cold water stop valve assembly 50. There is no need to destroy the wall or replace the whole faucet assembly.

Second, if pressure balance is needed, the valve cartridge 20 of the faucet assembly can be changed after disconnecting the faucet assembly. There is no need to destroy the wall.

Thirdly, via the arrangement of the hot water stop valve assembly 40 at the hot water inlet 100 and the cold water stop valve assembly 50 at the cold water inlet 102, the faucet assembly of the present invention can provide different properties.

While the present invention has been illustrated by the above description of the preferred embodiments thereof, while the preferred embodiments have been described in considerable detail, it is not intended to restrict or in any way to limit the scope of the appended claims to such details. Additional advantages and modifications within the spirit and scope of the present invention will readily appear to those ordinary skilled in the art. Consequently, the present invention is not limited to the specific details and the illustrative examples as shown and described.

What is claimed is:

1. A faucet assembly, comprising: a faucet body defining a hot water inlet, a cold water inlet and at least one water outlet; a valve cartridge having sealing and temperature control function detachably received in the faucet body, the valve cartridge defines a mixing chamber and the hot water from the hot water inlet and the cold water from the cold water inlet is mixed in the mixing chamber and flows out via the at least one water outlet; and a valve plate detachably assembled to the faucet body; wherein the faucet body is provided with a hot water pipe connecting the hot water inlet and the mixing chamber, the hot water pipe is formed with a hot water stop valve assembly detachably assembled thereto, the hot water stop valve assembly comprises a hot water stop valve body, a stop valve pole and a one-way valve, and the hot water stop valve body, the stop valve pole and the one-way valve are assembled before being mounted to the faucet body from a side of the faucet body; and the faucet body is provided with a cold water pipe connecting the cold water inlet and the mixing chamber, the cold water pipe is formed with a cold water stop valve assembly detachably assembled thereto, the cold water stop valve assembly comprises a cold water stop valve body, a stop valve pole and a one-way valve, and the cold water stop valve body, the stop valve pole and the one-way valve are assembled before being amounted to the faucet body from the side of the faucet body.

2. The faucet assembly of claim 1, wherein the hot water stop valve body defines a hot water hole corresponding to the one-way valve, and the hot water flows into the hot water valve body from the hot water inlet flows into the mixing chamber via the hot water hole; the cold water stop valve body defines a cold water hole corresponding to the one-way valve, and the cold water flows into the cold water valve body from the cold water inlet flows into the mixing chamber via the cold water hole.

3. The faucet assembly of claim 2, wherein the hot water stop valve body comprises a first positioning step for positioning the one-way valve and the cold water stop valve body defines a second positioning step for positioning the one-way valve.

4. The faucet assembly of claim 2, wherein a first filter is seated at the hot water hole connecting the hot water stop valve body and the mixing chamber, and a second filter is seated at the cold water hole connecting the cold water stop valve body and the mixing chamber.

5. The faucet assembly of claim 1, wherein a first sealing ring is seated between the hot water stop valve body and the faucet body, a second sealing ring is seated between the cold water stop valve body and the faucet body.

6. The faucet assembly of claim 1, wherein the valve cartridge is an ordinary thermostatic valve, a thermostatic valve having pressure balance function, or a thermostatic valve having closing function.

7. The faucet assembly of claim 1, wherein the at least one water outlet of the faucet body is formed with a two water change valve spool or a three water change valve spool.

8. The faucet assembly of claim 1, wherein the faucet body is detachably formed with a digital temperature display.

9. The faucet assembly of claim 1, wherein the valve cartridge is formed with a thermostat plastic sleeve.

* * * * *